US010442192B2

(12) United States Patent
Nomura

(10) Patent No.: US 10,442,192 B2
(45) Date of Patent: Oct. 15, 2019

(54) PRINT ELEMENT SUBSTRATE, PRINTHEAD, AND PRINTING APPARATUS

(71) Applicant: CANON KABUSHIKI KAISHA, Tokyo (JP)

(72) Inventor: Hiroyasu Nomura, Inagi (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/819,054

(22) Filed: Nov. 21, 2017

(65) Prior Publication Data

US 2018/0162123 A1 Jun. 14, 2018

(30) Foreign Application Priority Data

Dec. 12, 2016 (JP) ..... 2016-240563

(51) Int. Cl.

| | |
|---|---|
| ***B41J 2/045*** | (2006.01) |
| ***B41J 2/05*** | (2006.01) |
| ***B41J 2/145*** | (2006.01) |
| ***B41J 2/14*** | (2006.01) |

(52) U.S. Cl.

CPC ..... *B41J 2/0458* (2013.01); *B41J 2/0455* (2013.01); *B41J 2/04541* (2013.01); *B41J 2/04543* (2013.01); *B41J 2/04563* (2013.01); *B41J 2/05* (2013.01); *B41J 2/145* (2013.01); *B41J 2/14129* (2013.01); *B41J 2/14153* (2013.01)

(58) Field of Classification Search

CPC ..... B41J 2/04563; B41J 2/04541; B41J 2/14153; B41J 2002/14354

See application file for complete search history.

(56) References Cited

U.S. PATENT DOCUMENTS 6,154,229 A * 11/2000 Corrigan ..... B41J 2/04528 347/17
6,651,026 B2 * 11/2003 Yamauchi ..... G03G 15/2039 399/69
8,033,631 B2 10/2011 Kanno
8,616,672 B2 * 12/2013 Tatsumi ..... B41J 2/04528 347/14

(Continued)

FOREIGN PATENT DOCUMENTS

JP 2008-914 A 1/2008
JP 5265007 B 8/2013

OTHER PUBLICATIONS

U.S. Appl. No. 15/822,729, filed Nov. 27, 2017.

*Primary Examiner* — John Zimmermann
(74) *Attorney, Agent, or Firm* — Venable LLP

(57) ABSTRACT

A print element substrate, comprises: a first generating unit that selects a first sensor, and in a first period and a second period that follows the first period, generates a first temperature signal; a second generating unit that selects a second sensor, and in the second period and a third period that follows the second period, generates a second temperature signal; a processing unit that receives the first and second temperature signals, and based on values of the received signals, outputs a signal indicating a discharge; and a switching unit that outputs to the processing unit the first temperature signal from the start of the second period until a predetermined timing of the second period, and at the predetermined timing, switches a signal outputted from the first temperature signal to the second temperature signal.

23 Claims, 9 Drawing Sheets

(56) References Cited

U.S. PATENT DOCUMENTS

| | | | | |
|---|---|---|---|---|
| 9,174,437 | B2 * | 11/2015 | Hagiwara | B41J 2/072 |
| 2009/0273389 | A1 * | 11/2009 | Walmsley | B41J 2/04505<br>327/512 |
| 2010/0238226 | A1 * | 9/2010 | Tanaka | B41J 2/0454<br>347/17 |
| 2010/0315454 | A1 | 12/2010 | Kanno | |

* cited by examiner

PRINT ELEMENT SUBSTRATE, PRINTHEAD, AND PRINTING APPARATUS

BACKGROUND OF THE INVENTION

Field of the Invention

The present invention relates to a print element substrate, a printhead, and a printing apparatus.

Description of the Related Art

Among ink-jet printing methods that cause ink to be discharged from a nozzle and attached to a print medium such as paper, a thermal ink-jet printing method that causes ink to be discharged from a nozzle by thermal energy generated by a heater is known.

A method has been proposed in which, in an inkjet printing apparatus that uses this thermal ink-jet printing method, a heater driving pulse is re-used upon enabled/disabled switching of a temperature signal that is outputted from a temperature sensor arranged for a heater (refer to Japanese Patent No. 5265007). Also, a discharge state determination method (refer to Japanese Patent Laid-Open No. 2008-000914) that determines whether the state of discharge of ink from a nozzle is normal or there is a discharge failure by a point (hereinafter referred to as a feature point) where the speed at which the temperature detected by a temperature sensor drops changes suddenly has been proposed.

However, in the conventional technique, since, in synchronization with the timing of a heater driving pulse, simultaneously to disabling a temperature sensor output signal that is currently enabled, an output signal of a temperature sensor to be selected next is enabled, and a discontinuous step occurs in the output signal. So, there was the possibility that in processing for examining whether or not there is a feature point in the course a cooling of a temperature signal, a feature point could not be accurately acquired since when a step occurs in the cooling direction, the step portion would be mistakenly determined to be a sudden cooling, and the step portion would be misrecognized as a feature point.

SUMMARY OF THE INVENTION

The present invention, in order to resolve the foregoing issues, provides a configuration by which it is possible to suppress a step that occurs in a temperature signal upon switching a temperature sensor.

According to one aspect of the present invention, there is provided a print element substrate, comprising: a plurality of nozzles; heaters arranged in correspondence with the plurality of nozzles; a plurality of temperature sensors including a first sensor and a second sensor; a first generating unit configured to select the first sensor from the plurality of temperature sensors, and in a first period and a second period that follows the first period, generate a first temperature signal; a second generating unit configured to select the second sensor from the plurality of temperature sensors, and in the second period and a third period that follows the second period, generate a second temperature signal; a processing unit configured to receive the first temperature signal and the second temperature signal, and based on values of the received signals, output a signal indicating a discharge state; and a switching unit configured to output to the processing unit the first temperature signal from the start of the second period until a predetermined timing of the second period, and at the predetermined timing, to switch a signal to be outputted to the processing unit from the first temperature signal to the second temperature signal.

According to another aspect of the present invention, there is provided a printhead comprising a print element substrate, the print element substrate comprising: a plurality of nozzles; heaters arranged in correspondence with the plurality of nozzles; a plurality of temperature sensors including a first sensor and a second sensor; a first generating unit configured to select the first sensor from the plurality of temperature sensors, and in a first period and a second period that follows the first period, generate a first temperature signal; a second generating unit configured to select the second sensor from the plurality of temperature sensors, and in the second period and a third period that follows the second period, generate a second temperature signal; a processing unit configured to receive the first temperature signal and the second temperature signal, and based on values of the received signals, output a signal indicating a discharge state; and a switching unit configured to output to the processing unit the first temperature signal from the start of the second period until a predetermined timing of the second period, and at the predetermined timing, to switch a signal to be outputted to the processing unit from the first temperature signal to the second temperature signal.

According to another aspect of the present invention, there is provided a printing apparatus that has a printhead comprising a print element substrate, the print element substrate comprising: a plurality of nozzles; heaters arranged in correspondence with the plurality of nozzles; a plurality of temperature sensors including a first sensor and a second sensor; a first generating unit configured to select the first sensor from the plurality of temperature sensors, and in a first period and a second period that follows the first period, generate a first temperature signal; a second generating unit configured to select the second sensor from the plurality of temperature sensors, and in the second period and a third period that follows the second period, generate a second temperature signal; a processing unit configured to receive the first temperature signal and the second temperature signal, and based on values of the received signals, output a signal indicating a discharge state; a determination unit configured to determine a discharge state based on the signal indicating the discharge state outputted from the processing unit and output a determination result signal(RSLT); and a switching unit configured to output to the processing unit the first temperature signal from the start of the second period until a predetermined timing of the second period, and at the predetermined timing, to switch a signal to be outputted to the processing unit from the first temperature signal to the second temperature signal; and the printing apparatus comprising: a control unit configured to select a heater to be driven based on the determination result signal output from the determination unit.

By the invention of the present application, it is possible to suppress the occurrence of a step in a cooling direction upon a temperature sensor switch and to accurately examine a temperature signal cooling process without being influenced by a step portion.

Further features of the present invention will become apparent from the following description of exemplary embodiments (with reference to the attached drawings).

DESCRIPTION OF THE EMBODIMENTS

First Embodiment

With reference to the drawings, explanation is given below regarding an embodiment of the present invention.

Note that in this specification, "print" encompasses forming not only meaningful information such as characters and shapes, but also meaningless information. Furthermore, "print" broadly encompasses cases in which an image or pattern is formed on a print medium irrespective of whether or not it is something that a person can visually perceive, and cases in which a medium is processed.

Also, "print medium" broadly encompasses not only paper used in a typical printing apparatus, but also things that can receive ink such as cloths, plastic films, metal plates, glass, ceramics, wood materials, hides or the like.

Furthermore, similarly to the foregoing definition of "print", "ink" (also referred to as "liquid") should be broadly interpreted. Accordingly, "ink" encompasses liquids that by being applied to a print medium can be supplied in the forming of images, patterns or the like, processing of print mediums, or processing of ink (for example, insolubilization or freezing of a colorant in ink applied to a print medium).

Furthermore, "print element", unless specified otherwise, encompasses a discharge port and an element that produces energy that is used for discharge of ink and a fluid channel that communicates therewith collectively.

Furthermore, "nozzle", unless specified otherwise, encompasses a discharge port and an element that produces energy that is used for discharge of ink and a fluid channel that communicates therewith collectively.

An element substrate for a printhead (a head substrate) used below does not indicate a mere substrate consisting of a silicon semiconductor but rather indicates a configuration in which elements, wiring lines, and the like are disposed.

Furthermore, "on the substrate" means not only simply on top of the element substrate, but also the surface of the element substrate, and the inside of the element substrate in the vicinity of the surface.

Also, "built-in" in the present invention does not mean that separate elements are simply arranged as separate bodies on a substrate surface, but rather means that the elements are formed and manufactured integrally on the element board by a semiconductor circuit manufacturing process.

A printhead according to the present invention is used not only in a later-described serial type printing apparatus, but also in a printing apparatus comprising a full-line type printhead whose print width corresponds to the width of the print medium. Also, the printhead is used in large format printers that use print media of a large size such as A0 and B0 in serial type printing apparatuses.

[Device Configuration]

Figure 7A:
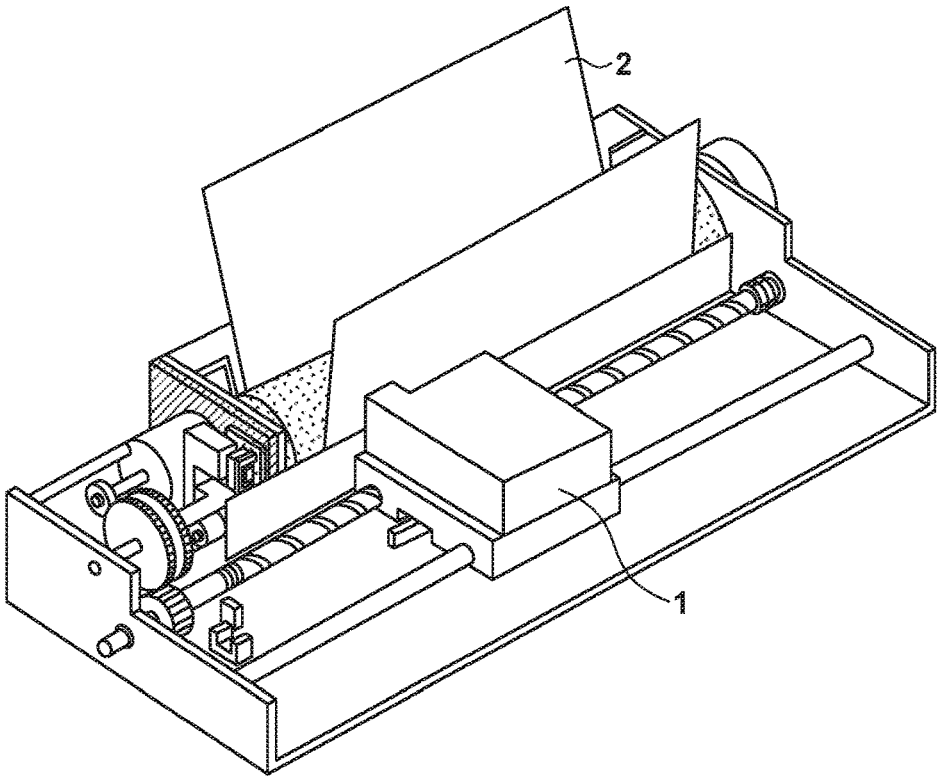
FIGS. 7A and 7B are schematic views which illustrate an example of a configuration of a main unit of a serial inkjet printing apparatus.
Figure 7B:
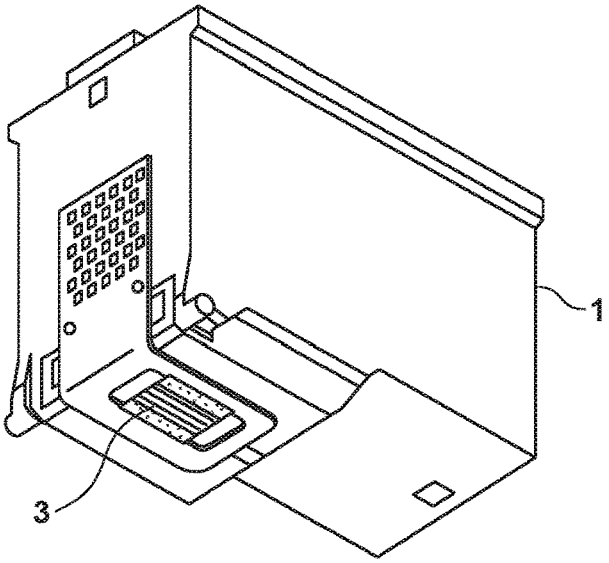

FIGS. 7A and 7B are schematic views that illustrate a configuration of a main part of a serial inkjet printing apparatus (hereinafter may be referred to simply as a printing apparatus) to which the present invention can be applied. FIG. 7A is an overall view which illustrates an overall configuration of the printing apparatus. Here, an example of a printhead of a serial type is illustrated. FIG. 7B is a perspective view which illustrates a printhead 1 which is a configuration element of the printing apparatus.

The printhead 1 prints an image on a print medium 2 by discharging ink droplets from a discharge port (not shown) corresponding to a nozzle. The printhead 1 comprises a print element substrate 3 that has a plurality of nozzle arrays in which a plurality of nozzles are arrayed.

Figure 8A:
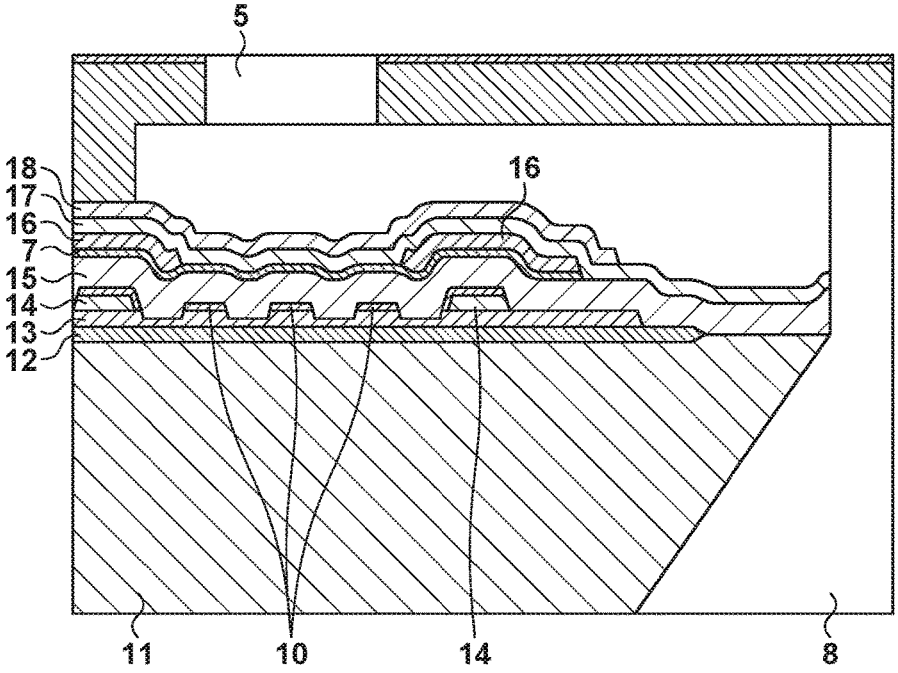
FIGS. 8A and 8B are a schematic partial cross-section view and plan view in which a heater surroundings of the print element substrate are magnified.
Figure 8B:
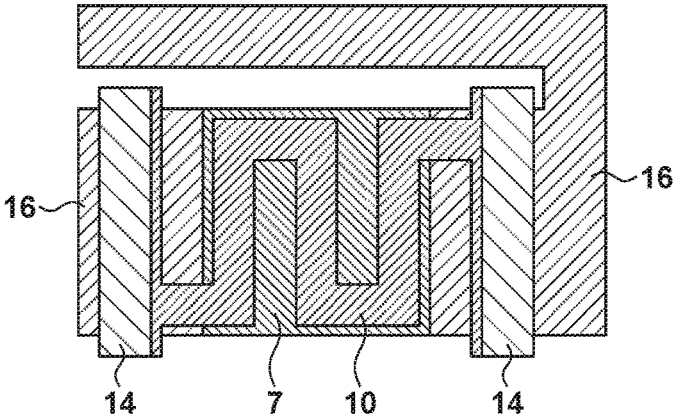

FIGS. 8A and 8B are views schematically illustrating a magnification of the surroundings of a heater 7 in the print element substrate 3. FIG. 8A is a cross-section view illustrating a magnification of the surroundings of the heater 7. FIG. 8B is a plan view illustrating a magnification of the surroundings of the heater 7 facing from the side of a temperature sensor 10 towards the heater 7.

In FIG. 8A, a heat storage layer comprising a thermal oxide film 12 ($SiO_2$) and a BPSG film 13 (a boron and phosphorous doped silicon oxide film) is formed on an Si substrate 11. Intermediated by the heat storage layer, the temperature sensor 10, an individual wiring line 14 made from Al or the like which is a wiring line of the temperature sensor 10, and an Al wiring line 16 which connects the heater 7 and a driving control circuit therefor (not shown), are formed on the Si substrate 11. The temperature sensor 10 is formed by a thin film resistor whose resistance value changes in accordance with temperature. Furthermore, on the Si substrate 11, intermediated by an interlayer insulation film 15, the heater 7, a passivation film 17 made of SiN or the like, and an anti-cavitation film 18 are formed to be stacked. The passivation film 17 is a film for protecting the semiconductor circuit layer from ink, and is formed entirely of P—SiN, for example. The anti-cavitation film 18 is a film for increasing resistance against cavitation that is formed on the heater 7, and it is formed only in the surroundings of the heater 7 out of Ta, for example. The temperature sensors 10 are arranged independently for each heater 7 directly below the respective heater 7. The individual wiring lines 14, which are connected to the temperature sensors 10 respectively, are configured as a part of a detection circuit for detecting temperature information.

Immediately above the heater 7, a discharge port 5 is arranged. Also, ink discharged from the discharge port 5 is supplied via a supply port 8.

In FIG. 8B, a planar shape of the temperature sensor 10 is of a serpentine shape whose resistance value is high in region that overlaps with the heater 7 in order to output even a tiny temperature fluctuation as a high voltage value. However, if it is a material whose TCR (Temperature Coefficient of Resistance) is high, the shape of the temperature sensor 10 may be a rectangle that is slightly smaller than the heater 7, for example.

Figure 9:
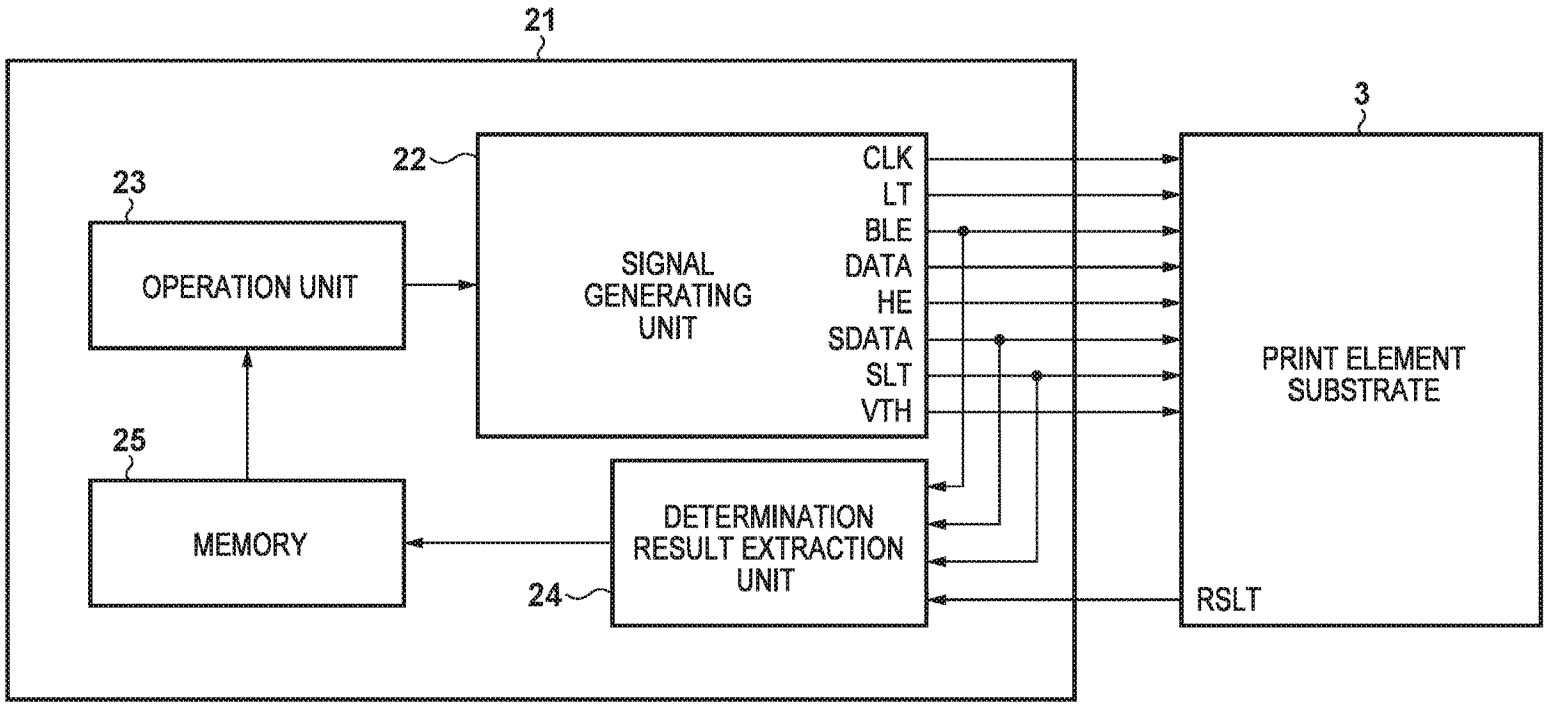
FIG. 9 is a view representing an example of a control configuration of an inspection apparatus.

FIG. 9 is a block diagram representing an example of a control configuration of an inspection apparatus 21. The inspection apparatus 21 comprises a signal generating unit 22, an operation unit 23, a determination result extraction unit 24, and a memory 25. The inspection apparatus 21 corresponds to a control unit that includes a CPU on the side of the image forming apparatus main body, for example. When the signal generating unit 22 receives an instruction from the operation unit 23, it outputs various input signals to the print element substrate 3. Here, the signal generating unit 22 outputs, as input signals to the print element substrate 3, a clock signal (CLK), a latch signal (LT), a block signal (BLE) which is four-bit serial data, a heater selection signal (DATA), and a heat-enable signal (HE). Furthermore, the signal generating unit 22 outputs, as input signals to the print element substrate 3, a sensor selection signal (SDATA), a sensor latch signal (SLT), and a threshold value signal (VTH), which are associated with temperature sensor selection and output signal processing.

Meanwhile, the determination result extraction unit 24 receives a determination result signal (RSLT) outputted from the print element substrate 3 based on the temperature information that the temperature sensor 10 detected, and extracts a determination result in synchronism with a sensor latch signal (SLT) for each block. Also, in the case where the determination result is a discharge failure, the determination result extraction unit 24 causes the memory 25 to store the block signal (BLE) and the sensor selection signal (SDATA). In other words, the determination result extraction unit 24 takes the determination result signal (RSLT) from the print element substrate 3, and the sensor latch signal (SLT), the block signal (BLE), and the sensor selection signal (SDATA) from the signal generating unit 22 as input signals.

When the operation unit 23 receives the block signal (BLE) and the sensor selection signal (SDATA) of discharge failure nozzles stored in the memory 25 and a discharge failure nozzle for a heater that is to be driven is included therein, the discharge failure nozzle is removed from the heater selection signal (DATA) for that block. Also, in its place, the operation unit 23 adds a nozzle to the heater selection signal (DATA) for that block to compensate for the discharge failure, and outputs the signal to the signal generating unit 22.

Figure 1:
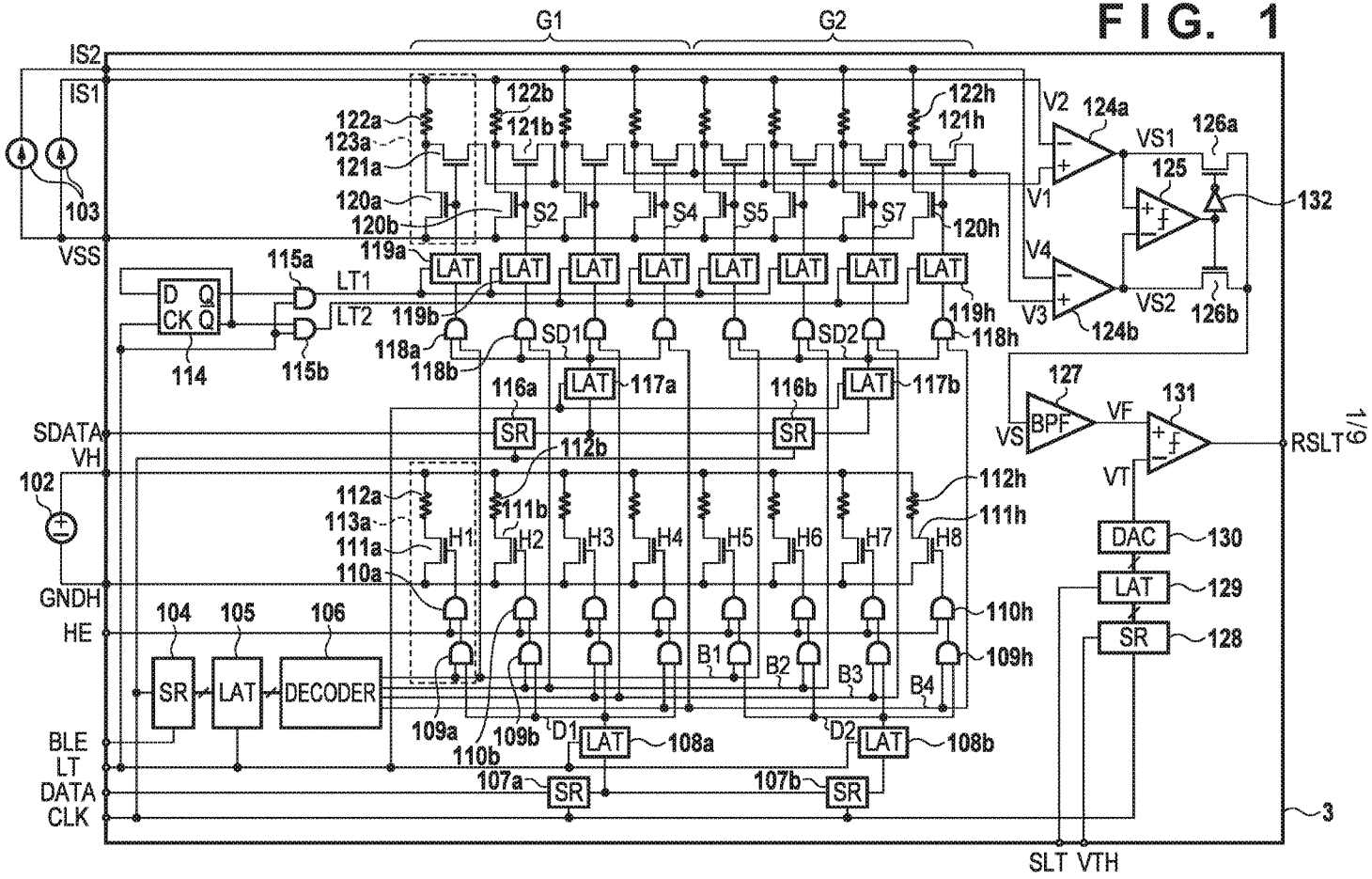
FIG. 1 is a view illustrating an example of a circuit configuration of a print element substrate according to a first embodiment.

FIG. 1 is a block diagram illustrating an example of a configuration of a heater driving circuit, and a temperature sensor output signal processing circuit implemented on the print element substrate 3, according to the present embodiment. Here, in order to simplify the explanation, it is assumed that the print element substrate 3 comprises eight heaters 112*a* to 112*h* and temperature sensors 122*a* to 122*h* respectively, and these are arranged in order as illustrated in FIG. 1.

The print element substrate 3 comprises a constant-voltage power supply 102 for driving the heaters 112*a* to 112*h*, a constant current source 103 for the temperature sensors 122*a* to 122*h*, and an input/output unit (pad or terminal) for inputting/outputting signals and information from the outside or to the outside.

A switch element (MOS transistor) 111*a*, together with a heater 112*a* and gate circuits 109*a* and 110*a*, constitutes one driving circuit 113*a*, and controls application of voltage of the constant-voltage power supply 102 to the heater 112*a*.

The switch element 120*a*, together with the switch element 121*a* and the temperature sensor 122*a*, constitutes one temperature acquiring circuit 123*a*, and controls application of current of the constant current source 103 to the temperature sensor 122*a*. Also, the switch element 121*a* controls output of voltage generated in the temperature sensor 122*a* to a differential amplifier 124*a*. The temperature sensor 122*a* measures temperature corresponding to the heater 112*a*.

The other seven heaters and temperature sensors are similarly controlled by switch elements. Accordingly, the eight driving circuits 113*a* to 113*h* and the eight temperature acquiring circuits 123*a* to 123*h* are comprised in the circuit configuration of FIG. 1. Also, the eight driving circuits 113*a* to 113*h* and the eight temperature acquiring circuits 123*a* to 123*h* are respectively separated into two groups G1 and G2. Each group is composed of 4 driving circuits and 4 temperature acquiring circuits.

[Logic circuit]

Figure 2:
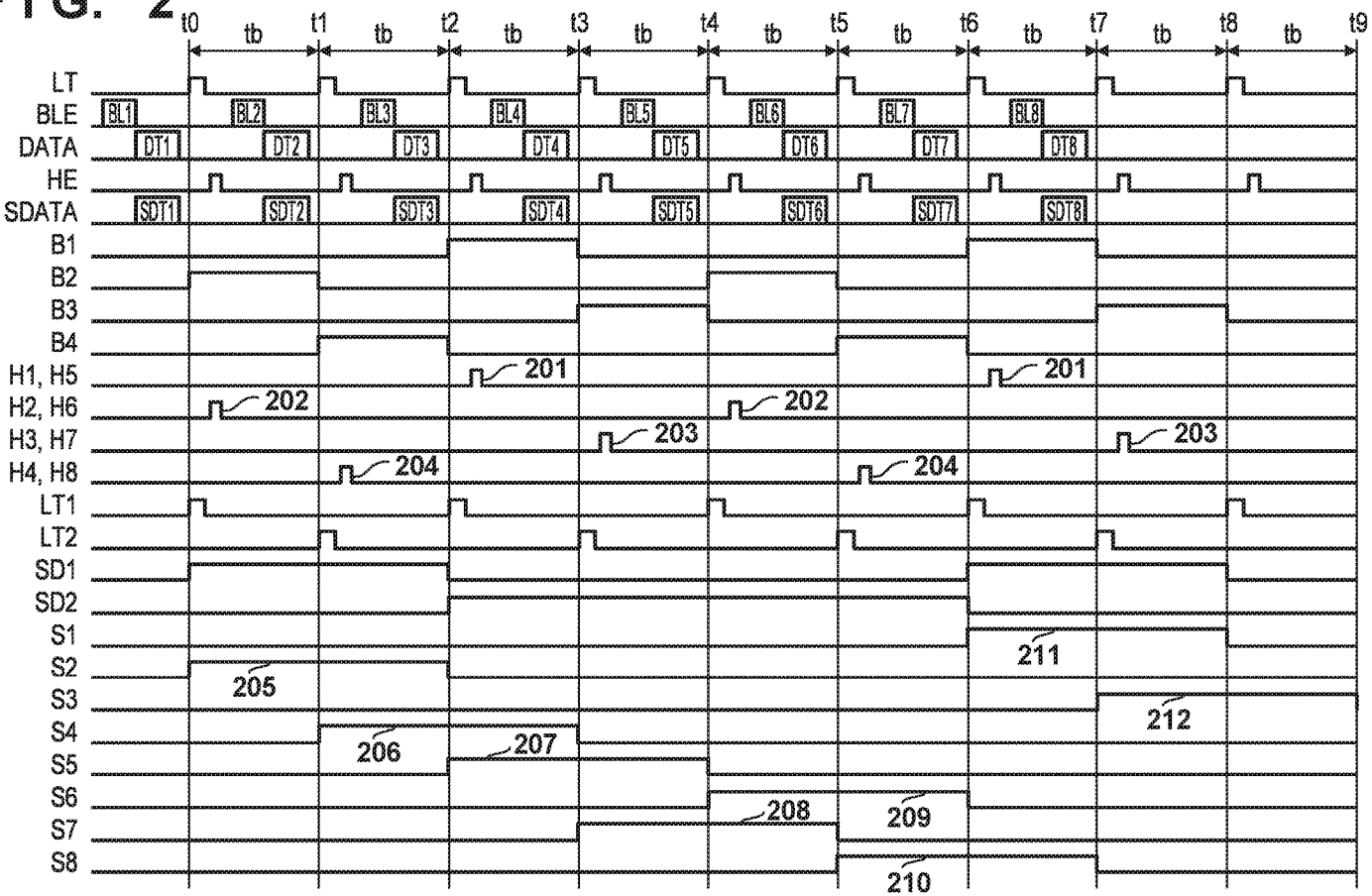
FIG. 2 is a timing chart of a logic circuit unit according to the first embodiment.

FIG. 2 is a timing chart that represents the timing of control in a logic circuit unit of the print element substrate 3. Below, based on FIG. 1 and FIG. 2, operation of the logic circuit unit of the print element substrate 3 of the present embodiment will be described.

The print element substrate 3 receives the clock signal (CLK), the latch signal (LT), the block signal (BLE) which is two-bit serial data, the heater selection signal (DATA) which is two bit serial data, and the heat-enable signal (HE) which are transferred from the inspection apparatus 21. Furthermore, the print element substrate 3 receives the sensor selection signal (SDATA) which is two-bit serial data. Those other than the clock signal (CLK) are received at an interval of a block period tb. Specifically, control of the eight driving circuits 113*a* to 113*h* and the eight temperature acquiring circuits 123*a* to 123*h* is performed time-divisionally in four blocks.

Block signals BL1 to BL8 are transferred to a shift register 104 in synchronism with the clock signal (CLK), and are latched by a latch circuit 105 at timings t0 to t7 respectively. Furthermore, the block signals BL1 to BL8 latched by the latch circuit 105 are decoded by a decoder 106, and outputted to wiring lines B1 to B4. Signals of the wiring lines B1 to B4 are held for tb until the next latch timing, and in that time the next block signal is transferred to the shift register 104.

Only one of the four signals of the wiring lines B1 to B4 is enabled, and is used to select the heaters to drive simultaneously. In FIG. 1, the wiring line B1 is connected with gate circuits 109*a* and 109*e*. Accordingly, if the signal of the wiring line B1 is enabled (High active), the heaters 112*a* and 112*e* can be driven simultaneously. Similarly, if the signal of the wiring line B2 is enabled, the heaters 112*b* and 112*f* can be driven simultaneously, if the signal of the wiring line B3 is enabled, the heaters 112*c* and 112*g* can be driven simultaneously, and if the signal of the wiring line B4 is enabled, the heaters 112*d* and 112*h* can be driven simultaneously.

As illustrated in FIG. 2, in the present embodiment, so not to drive adjacent heaters consecutively, configuration is taken to handle a case in which heaters are driven time-divisionally, where B2 is enabled during t0 to t1, B4 is enabled during t1 to t2, B1 is enabled during t2 to t3, and B3 is enabled during t3 to t4.

Heater selection signals DT1 to DT8 are transferred to shift registers 107*a* and 107*b* in synchronism with the clock signal (CLK), and are latched by the latch circuits 108*a* and 108*b* at the timings t0 to t7 respectively. Furthermore, the heater selection signals DT1 to DT8 latched by the latch circuits 108*a* and 108*b* are outputted to wiring lines D1 and D2. The signals of the wiring lines D1 and D2 are held during tb until the next latch timing, and during that time the next heater selection signal is transferred to the shift registers 107*a* and 107*b*, and the signals of the wiring lines D1 and D2 are held during tb until the next latch timing, and during that time the next heater selection signal is transferred to the shift registers 107*a* and 107*b*.

The signals of wiring lines D1 and D2 are used for selecting the heater groups G1 and G2. In FIG. 1, the wiring line D1 is connected to the gate circuits 109*a* to 109*d*. Accordingly, if the signal of the wiring line D1 is enabled (High active), the heaters 112*a* to 112*d* of the group G1 can be selected. Similarly, if the signal of the wiring line D2 is enabled, the heaters 112*e* to 112*h* of the G2 can be selected.

In the present embodiment, configuration is taken to handle a case in which, over four consecutive periods of the block period tb (t0 to t4), heaters of all groups are selected (enable both D1 and D2). Specifically, driving of all eight of the heaters is completed in the period from t0 to t4.

The signals of the wiring lines B1 to B4, together with the signal of the wiring line D1, are respectively inputted into the gate circuits 109*a* to 109*d*. The output signals of the gate circuits 109*a* to 109*d*, together with the heat-enable signal (HE) are further respectively inputted into the gate circuits 110*a* to 110*d*. The gate circuits 110*a* to 110*d* output pulse signals 201 to 204 into wiring lines H1 to H4 respectively. The wiring lines H1 to H4 are respectively connected to the switch elements 111*a* to 111*d*, and the heaters 112*a* to 112*d* are respectively driven by the pulse signals 201 to 204.

Similarly, the pulse signals 201 to 204 are respectively outputted to wiring lines H5 to H8 by the gate circuits 110*e* to 110*h*. The wiring lines H5 to H8 are respectively connected to the switch elements 111*e* to 111*h*, and the heaters 112*e* to 112*h* are respectively driven by the pulse signals 201 to 204.

Sensor selection signals SDT1 to SDT8 are transferred to the shift registers 116*a* and 116*b* in synchronism with the clock signal (CLK), and are latched by the latch circuits 117*a* and 117*b* at the timings t0 to t3 respectively. Furthermore, the sensor selection signals SDT1 to SDT8 latched by the latch circuits 117*a* and 117*b* are outputted to wiring lines SD1 and SD2. Signals of the wiring lines SD1 and SD2 are held for tb until the next latch timing, and in that time the next the heater selection signal is transferred to the shift registers 116*a* and 116*b*.

The signals of the wiring lines SD1 and SD2 are used to select one of the groups G1 and G2 in which a temperature sensor corresponding to a heater to be driven is included, by the signal that enables only one among the heater selection signals to be enabled. In FIG. 1, the wiring line SD1 connected to the gate circuits 118*a* to 118*d*. Accordingly, if the signal of the wiring line SD1 is enabled (High active), the temperature sensors 122*a* to 122*d* of the group G1 can be selected. Similarly, if the signal of the wiring line SD2 is enabled, the temperature sensors 122*e* to 122*h* of the G2 can be selected.

As illustrated in FIG. 2, in the present embodiment, configuration is taken to handle a case in which the signal of wiring line SD1 is enabled during t0 to t1 and during t1 to t2 among four consecutive block periods tb, and the temperature sensors of the group G1 are selected. Also, configuration is taken to handle a case in which during t2 to t3 and during t3 to t4, the signal of the wiring line SD2 is enabled and the temperature sensors of the group G2 are selected.

The block signal for selecting the temperature sensor re-uses the signals of the wiring lines B1 to B4. Specifically, together with the signal of the wiring line SD1, the signals of the wiring lines B1 to B4 are respectively inputted into the gate circuits 118*a* to 118*d*. Similarly, the signals of the wiring lines B1 to B4, together with the signal of the wiring line SD2, are respectively inputted into the gate circuits 118*e* to 118*h*.

The output signals of the gate circuits 118*a* to 118*h* are signals synchronized to the latch signal (LT), and therefore are only held for the block period tb. However, to compare output of a temperature sensor in a particular block (group) with the output of a temperature sensor of the next block, it is necessary to output after dividing the temperature sensors into those of odd blocks and those of even blocks. Also, it is necessary to hold sensor output during two consecutive block periods tb. Accordingly, latch circuits 119*a* to 119*h*, which latch the output signals of the gate circuits 118*a* to 118*h*, and hold them for two block periods, are provided.

The latch signals LT1 and LT2 inputted into the latch circuits 119*a* to 119*h* are generated dividing the latch signal (LT) into two periods by a flip flop circuit 114, and then taking an AND of those with the original latch signal (LT) by gate circuits. A latch signal LT1 that latches the output signals of the gate circuits into which the signals of wiring lines B1 and B2 are inputted is generated by taking an AND of the output of the flip flop circuit 114 and the latch signal (LT) by a gate circuit 115*a*. Also, the latch signal LT2 that latches the output signals of the gate circuits into which the signals of wiring lines B3 and B4 are inputted is generated by taking an AND of the reverse output of the flip flop circuit 114 and the latch signal (LT) by a gate circuit 115*b*.

By the above, a pulse signal 205 is outputted to a wiring line S2 by the latch circuit 119*b* during t0 to t2. From t1 to t3, a pulse signal 206 is outputted to a wiring line S4 by the latch circuit 119*d*. From t2 to t4, a pulse signal 207 is outputted to a wiring line S5 by the latch circuit 119*e*. From t3 to t5, a pulse signal 208 is outputted to a wiring line S7 by the latch circuit 119*g*.

Similarly, from t4 to t6, a pulse signal 209 is outputted to a wiring line S6, from t5 to t7, a pulse signal 210 is outputted to a wiring line S8, from t6 to t8, a pulse signal 211 is outputted to a wiring line S1, and from t7 to t9, a pulse signal 212 is outputted to a wiring line S3. Also, during t2 to t6, SD2 is enabled. Between t0 to t2 and between t6 to t8, SD1 is enabled.

The wiring line S2 is connected to the switch elements 120*b* and 121*b*. On the wiring line S2, a constant current is applied to the temperature sensor 122*b* during t0 to t2 by the pulse signal 205 and a voltage generated in the temperature sensor 122*b* is outputted to the differential amplifier 124*a*. The wiring line S5 is connected to the switch elements 120*e* and 121*e*. On the wiring line S5, the constant current is applied to the temperature sensor 122*e* during t2 to t4 by the pulse signal 207 and a voltage generated in the temperature sensor 122*e* is outputted to the differential amplifier 124*a*.

The wiring line S4 is connected to the switch elements 120*d* and 121*d*. On the wiring line S4, the constant current is applied to the temperature sensor 122*d* during t1 to t3 by the pulse signal 206 and a voltage generated in the temperature sensor 122*d* is outputted to the differential amplifier 124*b*. The wiring line S7 is connected to the switch elements 120*g* and 121*g*. On the wiring line S7, a constant current is applied to the temperature sensor 122*g* during t3 to t5 by the pulse signal 208 and a voltage generated in the temperature sensor 122*g* is outputted to the differential amplifier 124*b*.

[Analog Signal Process]

Figure 3:
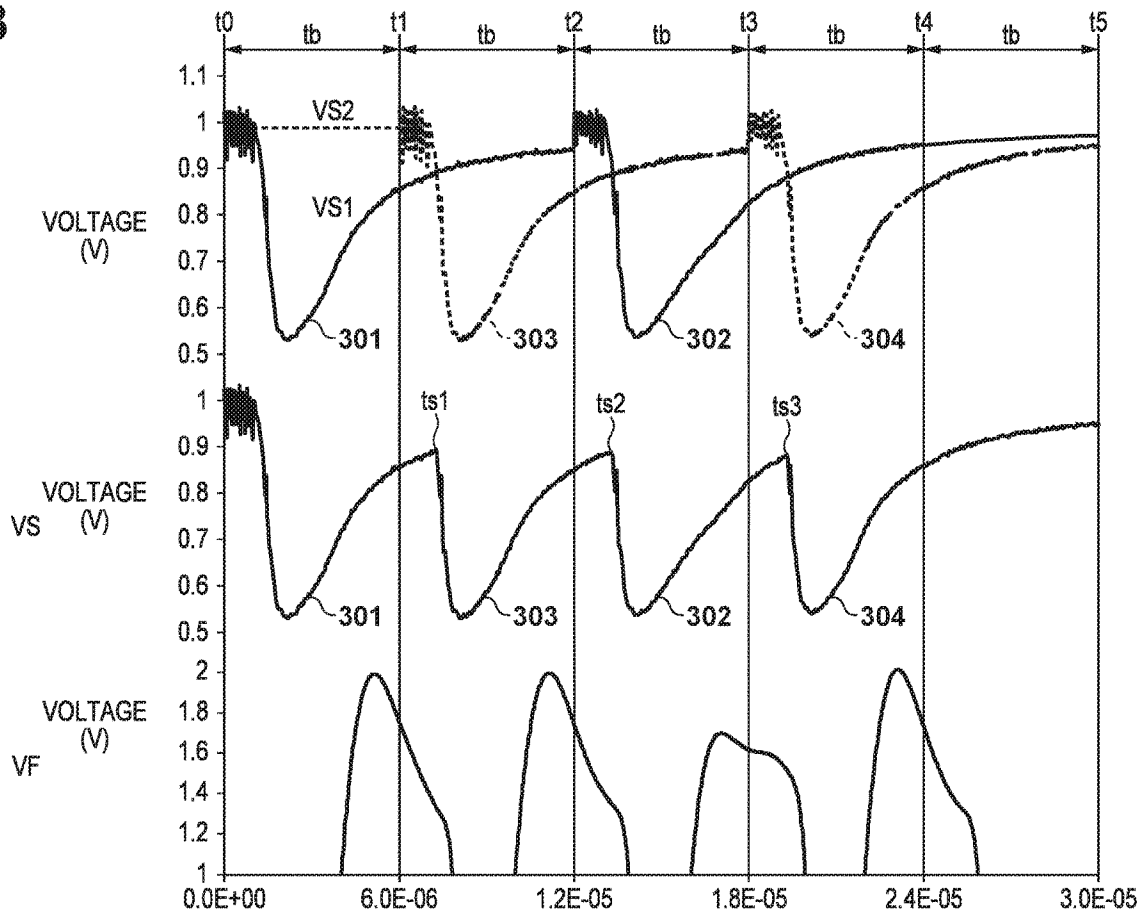
FIG. 3 is a timing chart of an analog signal processing unit according to the first embodiment.

FIG. 3 is a timing chart that represents the timing of control in an analog signal processing unit of the print element substrate 3. Below, based on FIG. 1 and FIG. 3, operation of an analog signal processing unit of the print element substrate 3 according to the present embodiment will be described.

The differential amplifier 124*a* outputs (301 and 302) consecutively the voltage VS1 (temperature information) resulting from subtracting the voltage V2 on the IS1 terminal side from the voltage V1 on the VSS terminal side of the temperature sensor 122*b* selected by the wiring line S2 and the temperature sensor 122*e* selected by the wiring line S5. The differential amplifier 124*b* outputs (303 and 304) consecutively the voltage VS2 (temperature information) resulting from subtracting the voltage V4 on the IS2 terminal side from the voltage V3 on the VSS terminal side of the temperature sensor 122*d* selected by the wiring line S4 and the temperature sensor 122*g* selected by the wiring line S7. The output of the differential amplifiers 124*a* and 124*b* here is indicated in the top part of FIG. 3.

The voltages VS1 and VS2 are inputted into a comparator 125. The comparator 125 outputs Low when VS1<VS2 and outputs High when VS1>VS2. Because the voltages VS1 and VS2 are information in which the temperature is inverted, the lower the voltage, the higher the temperature. Accordingly, since the higher of the temperatures of the voltages VS1 and VS2 is outputted, the output of the comparator 125 is inverted by an inverter 132 and inputted into the switch element 126*a*, and the output of the comparator 125 is inputted as is into the switch element 126*b*.

As illustrated in the middle part of FIG. 3, during t0 to ts1 and during ts2 to ts3, VS1<VS2, and therefore the switch element 126*a* becomes ON, and on the other hand the switch element 126*b* becomes OFF. Also, the voltage 301 that is generated in the temperature sensor 122*b* and the voltage 302 generated in the temperature sensor 122*e* are respectively outputted as the voltage VS.

Next, during ts1 to ts2 and during ts3 to t5, VS1>VS2, and therefore the switch element 126*a* becomes OFF, and on the other hand the switch element 126*b* becomes ON. Then, a voltage 303 that is generated in the temperature sensor 122*d* and a voltage 304 generated in the temperature sensor 122*g* are respectively outputted as the voltage VS.

The timings ts1, ts2, and ts3 are the moments where VS1=VS2, and thereafter VS changes in the direction in which the temperature rises, and so that change is not misrecognized as a cooling change at a normal discharge feature point. Note that if the difference between VS1 and VS2 is small enough that the difference is not misrecognized as a cooling change at a normal discharge feature point, the outputs may be switched even in a state in which there remains a voltage difference between VS1 and VS2. In other words, if the voltage difference between VS1 and VS2 is smaller than a pre-determined amount, the output may be switched.

The voltage VS is inputted into the bandpass filter (BPF) 127. The bandpass filter 127 attenuates high frequency noise from the voltage VS, extracts a cooling rate, and outputs a signal VF which becomes the basis for a determination as to whether there is normal discharge or a discharge failure. When the cooling rate is largest, the signal VF becomes a maximum. It is assumed that configuration is taken to define in advance a particular passband through which the bandpass filter (BPF) 127 allows the voltage VS to pass. The signal VF is illustrated in the bottom part of FIG. 3.

Figure 4:
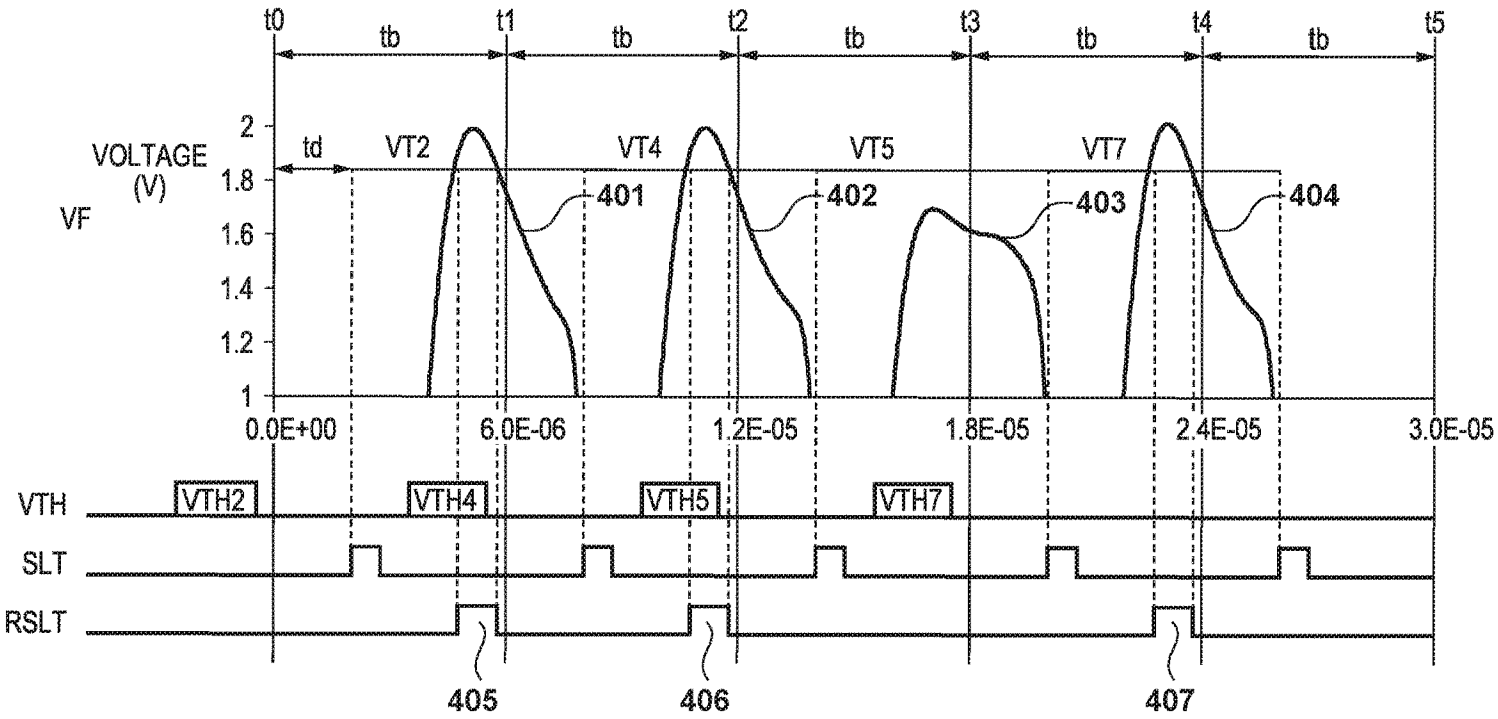
FIG. 4 is a timing chart of a determination circuit unit according to the first embodiment.

FIG. 4 is a timing chart that represents the timing of control in a determination circuit unit of the print element substrate 3. Below, based on FIG. 1 and FIG. 4, operation of the determination circuit unit of the print element substrate 3 according to the present embodiment will be described. It is assumed that the signal VF illustrated in FIG. 4 corresponds to the signal VF which is illustrated in the bottom part of FIG. 3.

The print element substrate 3 receives a sensor latch signal (SLT) transferred from the inspection apparatus 21 and a threshold value signal (VTH) which is eight-bit serial data in an interval of the block period tb. The sensor latch signal (SLT) is a signal that delays the latch signal (LT) by a delay amount td with respect to the input, which is the output of the bandpass filter (BPF) 127.

The threshold value signals VTH 2, VTH 4, VTH 5, and VTH 7 are transferred to a shift register 128 in synchronization with the clock signal (CLK). Also, the threshold value signals VTH 2, VTH 4, VTH 5, and VTH 7 are latched in a latch circuit 129 at the timings t0+td to t3+td, and are outputted to a digital/analog converter (DAC) 130. The output signal of the latch circuit 129 is held during the block period tb until the next latch timing, and during that time the next threshold value signal is transferred to the shift register 128.

The output signal of the digital/analog converter (DAC) 130 is inputted to the negative terminal of a comparator 131 as a threshold voltage VT. Meanwhile, the output signal VF of the bandpass filter 127 is inputted into the positive terminal of the comparator 131. The comparator 131 compares the signal VF and the threshold voltage VT, and if VF>VT, a determination result signal (RSLT) that is enabled (normal discharge) is outputted.

In FIG. 4, peaks that exceed the threshold voltage VT derived from normal discharge occur in the signals 401, 402, and 404, and pulse signals 405, 406, and 407 that depend on these respectively occur in the determination result signal (RSLT). Meanwhile, since the signal 403 is a signal based on a discharge failure temperature signal (the voltage 302), no peak derived from a normal discharge occurs, and the pulse signal does not occur in the determination result signal (RSLT). These determination results are extracted in synchronism with the sensor latch signal (SLT) in the determination of each block by the determination result extraction unit 24 illustrated in FIG. 9.

By the invention of the present application, it is possible to suppress the occurrence of a step in a cooling direction upon a temperature sensor switch and to accurately examine a temperature signal cooling process without being influenced by a step portion.

Second Embodiment

Figure 5:
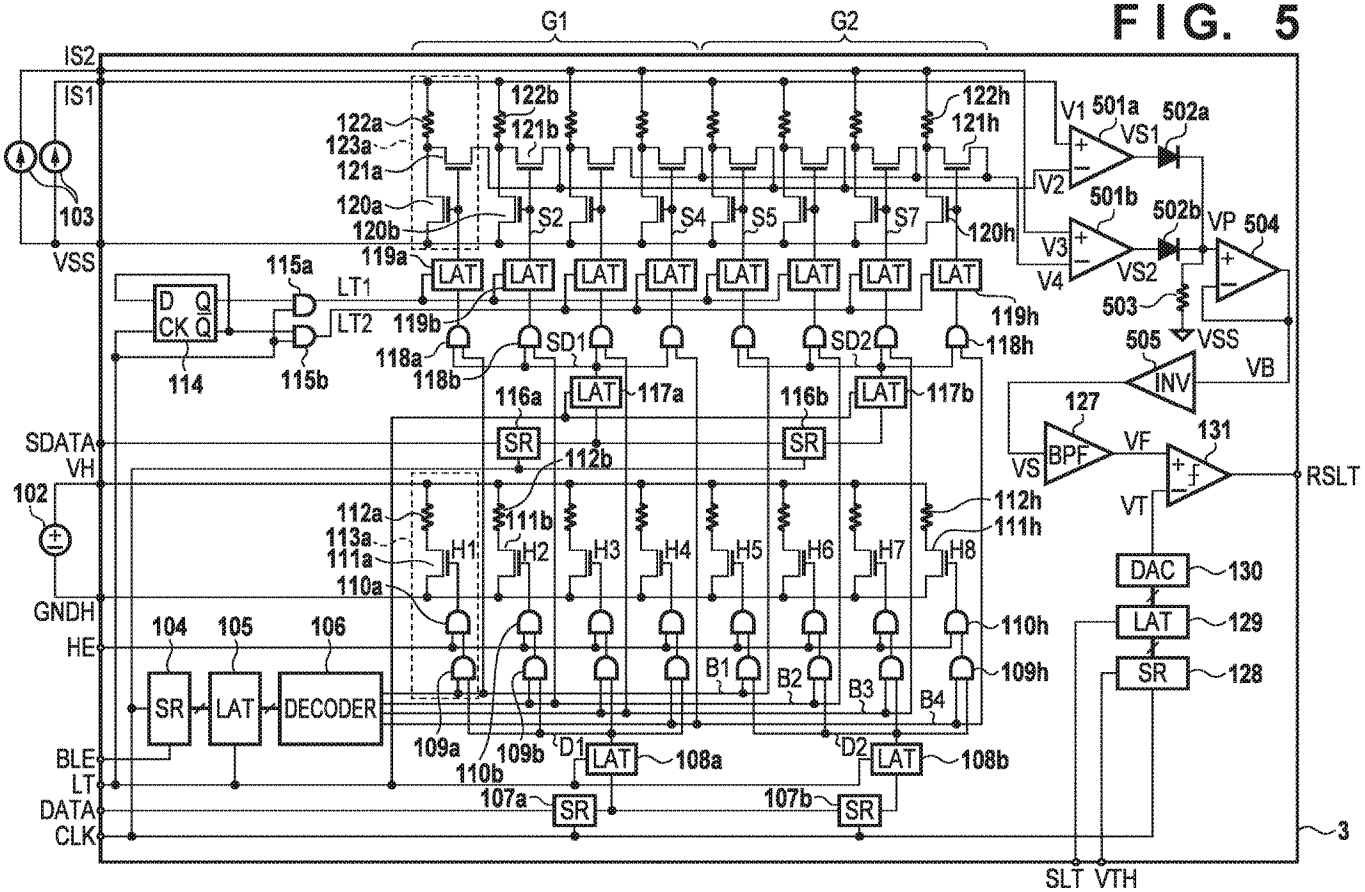
FIG. 5 is a view illustrating an example of a circuit configuration of a print element substrate according to a second embodiment.

FIG. 5 is a block diagram illustrating an example of a configuration of a heater driving circuit, and a temperature sensor output signal processing circuit implemented on the print element substrate 3, according to a second embodiment of the invention of the present application. In FIG. 5, other than the analog signal processing unit configured by a maximum value circuit, the logic circuit unit and the determination circuit unit are the same as in the first embodiment, and so description thereof is omitted.

Figure 6:
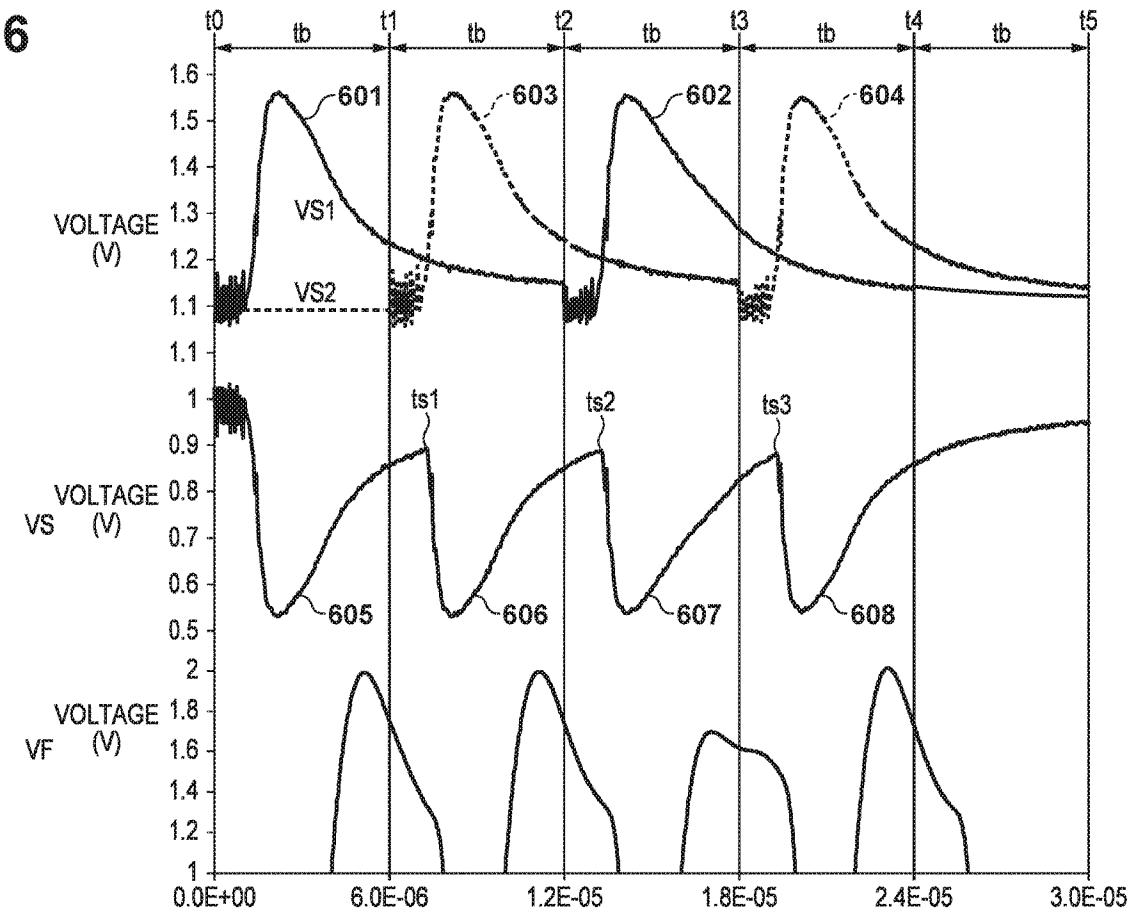
FIG. 6 is a timing chart of an analog signal processing unit according to the second embodiment.

FIG. 6 is a timing chart which represents a control timing in an analog signal processing unit of print element substrate illustrated in FIG. 5. Below, based on FIG. 5 and FIG. 6, explanation will be given for an operation of the analog signal processing unit of the print element substrate 3 in the present embodiment.

A differential amplifier 501*a* outputs (601 and 602) consecutively the voltage VS1 (temperature information) resulting from subtracting the voltage V2 on the VSS terminal side from the voltage V1 on the IS1 terminal side of the temperature sensor 122*b* selected by the wiring line S2 and the temperature sensor 122*e* selected by the wiring line S5. A differential amplifier 501*b* outputs (603 and 604) consecutively the voltage VS2 (temperature information) resulting from subtracting the voltage V4 on the VSS terminal side from the voltage V3 on the IS2 terminal side of the temperature sensor 122*d* selected by the wiring line S4 and the temperature sensor 122*g* selected by the wiring line S7. Respective outputs of differential amplifiers 501*a* and 501*b* are indicated in top part of FIG. 6.

The voltages VS1 and VS2 are inputted into the positive terminal of a buffer circuit 504 which is configured by an operational amplifier via the diodes 502*a* and 502*b* respectively. The voltage VP of the positive terminal of the buffer circuit 504 is the larger of VS1-Vf and VS2-Vf, where a diode forward-voltage drop Vf is subtracted from the voltages VS1 and VS2 respectively. Current does not flow to the diode whose voltage is smaller, and a current determined by the voltage VP and the resistance value of a resistor 503 flows to the diode whose voltage is larger. One end of the resistor 503 is connected to the voltage VSS.

The temperature and sign of the voltages VS1 and VS2 are the same, and therefore the voltage VB, which results from subtracting the diode forward-voltage drop Vf from whichever of the voltages VS1 and VS2 has the higher temperature, is outputted from the buffer circuit 504. Regarding the diode forward-voltage drop Vf, a bias is applied in advance to the voltages VS1 and VS2 respectively by the differential amplifiers 501*a* and 501*b*.

As illustrated in the top part of FIG. 6, VS1 >VS2 between t0 to ts1 and between ts2 to ts3. For this reason, the voltage VB is a value resulting from subtracting the voltage Vf from the voltages 601 and 602 respectively. A voltage 605 and a voltage 607 which result from inversion of VB by an inversion circuit 505 are outputted as the voltage VS. Also, as illustrated in the top part of FIG. 6, VS1<VS2 between ts1 to ts2 and between ts3 to t5. For this reason, the voltage VB is a value resulting from subtracting the voltage Vf from the voltages 603 and 604 respectively. A voltage 606 and a voltage 608 which result from inversion of VB by the inversion circuit 505 are outputted as the voltage VS. The voltage VS is indicated in middle of FIG. 6.

The timings ts1, ts2, and ts3 indicated in the middle part of FIG. 6 are the moments where VS1=VS2, and since thereafter, VS changes in the heating direction (the direction in which the voltage becomes lower), a cooling change at a normal discharge feature point is not misrecognized. Note that if the difference between VS1 and VS2 is small enough that a cooling change at a normal discharge feature point is not misrecognized, the outputs may be switched even in a state in which there remains a voltage difference between VS1 and VS2. A range in which there is no misrecognition is determined such that the amount of change that occurs when switching the temperature signal does not exceed the amount of change of cooling that should be detected in the temperature signal. Also, this range is identified in advance as a predetermined range, and the circuit is designed based thereon.

The voltage VS is inputted into the bandpass filter 127. The bandpass filter 127 attenuates high frequency noise from the inputted voltage VS, extracts a cooling rate, and outputs a signal VF which becomes the basis for a determination as to whether it is a normal discharge or a discharge failure. Hereinafter operation is the same as in the first embodiment.

As described above, in the analog signal processing unit according to the present embodiment, because the input voltage of the buffer circuit 504 switches to whichever of the voltages VS1 and VS2 has the higher temperature without using a switching element as described in the first embodiment, switching noise is not generated. Also, unlike a comparator which can only handle two inputs as in the first embodiment, the diodes connected to the input terminals of the buffer circuit 504 can be increased to thereby enable three or more inputs to be handled.

Other Embodiments

Note the present invention is not limited to values and configurations which are described in the embodiments described above. For example, the number of heaters and temperature sensors that the print element substrate 3 comprises is not limited to eight, and may be 64, 128, 256 or the like.

Also, the signals of the wiring lines B1 to B4 were re-used for the block signals for selecting the temperature sensor, but dedicated block signals and wiring lines that extend the effective period for temperature sensor selection to 2tb may be used. In this case, latch circuits 119*a* to 119*h* become unnecessary. Also, the temperature sensor selection period is not limited to two period divisions of block period tb, and may be three or more period divisions.

Also, while the inspection apparatus 21 which is a temperature measurement apparatus and is illustrated in FIG. 9 and the print element substrate 3 are illustrated in a one-to-one relationship, configuration may be such that there is one inspection apparatus 21 for a plurality of print element substrates. Also, the inspection apparatus 21 may be integrated in a control unit (such as a CPU or the like) for performing image forming processing.

Also, in the first embodiment, an example in which the configuration elements 124 to 132 of FIG. 1 are configured in the print element substrate 3 is described. However, limitation is not made to this configuration, and these configuration elements may be arranged outside of the print element substrate 3. Similarly, in the second embodiment, an example in which the configuration elements 127 to 131 and 501 to 505 of FIG. 5 are configured in the print element substrate 3 is described. These configuration elements may be arranged outside of the print element substrate 3.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-240563, filed Dec. 12, 2016, which is hereby incorporated by reference herein in its entirety.

What is claimed is:

1. A print element substrate comprising:

a plurality of nozzles;

heaters arranged in correspondence with the plurality of nozzles;

a plurality of temperature sensors including a first sensor and a second sensor;

a first generating unit configured to select the first sensor from the plurality of temperature sensors, and in a first period and a second period that follows the first period, generate a first temperature signal;

a second generating unit configured to select the second sensor from the plurality of temperature sensors, and in the second period and a third period that follows the second period, generate a second temperature signal;

a processing unit configured to receive the first temperature signal and the second temperature signal, and based on values of the received signals, output a signal indicating a discharge state; and a switching unit configured to output to the processing unit the first temperature signal from the start of the second period until a predetermined timing of the second period, and at the predetermined timing, to switch a signal to be outputted to the processing unit from the first temperature signal to the second temperature signal.

2. The print element substrate according to claim 1, wherein a waveform of the first temperature signal is concave up in the first period, and a waveform of the second temperature signal is concave up in the second period, and at a start timing of the second period, a value of the second temperature signal is higher than a value of the first temperature signal.

3. The print element substrate according to claim 2, wherein the processing unit includes an acquiring unit configured to acquire a value of a slope of a rising edge of the first temperature signal in the first period and acquire a value of a slope of a rising edge of the second temperature signal in the second period, and a determination unit configured to generate a signal indicating a discharge state about the first sensor and generate a signal indicating a discharge state about the second sensor, based on the value of the slope acquired by the acquiring unit and a threshold value.

4. The print element substrate according to claim 1, wherein a waveform of the first temperature signal is concave down in the first period, and a waveform of the second temperature signal is concave down in the second period, and at a start timing of the second period, a value of the second temperature signal is lower than a value of the first temperature signal.

5. The print element substrate according to claim 4, wherein the processing unit includes an acquiring unit configured to acquire a value of a slope of a falling edge of the first temperature signal in the first period and acquire a value of a slope of a falling edge of the second temperature signal in the second period, and a determination unit configured to generate a signal indicating a discharge state about the first sensor and generate a signal indicating a discharge state about the second sensor, based on the value of the slope acquired by the acquiring unit and a threshold value.

6. The print element substrate according to claim 1, wherein at the predetermined timing, a difference between values of the first temperature signal and the second temperature signal is smaller than a predetermined value.

7. The print element substrate according to claim 1, wherein at the predetermined timing, the value of the first temperature signal is equal to the value of the second temperature signal.

8. The print element substrate according to claim 1, wherein the first and second generating units each include a differential amplifier.

9. The print element substrate according to claim 1, wherein the processing unit includes a bandpass filter.

10. A printhead comprising a print element substrate, the print element substrate comprising:

a plurality of nozzles;

heaters arranged in correspondence with the plurality of nozzles;

a plurality of temperature sensors including a first sensor and a second sensor;

a first generating unit configured to select the first sensor from the plurality of temperature sensors, and in a first period and a second period that follows the first period, generate a first temperature signal;

a second generating unit configured to select the second sensor from the plurality of temperature sensors, and in the second period and a third period that follows the second period, generate a second temperature signal;

a processing unit configured to receive the first temperature signal and the second temperature signal, and based on values of the received signals, output a signal indicating a discharge state; and a switching unit configured to output to the processing unit the first temperature signal from the start of the second period until a predetermined timing of the second period, and at the predetermined timing, to switch a signal to be outputted to the processing unit from the first temperature signal to the second temperature signal.

11. A printing apparatus that has a printhead comprising a print element substrate, the print element substrate comprising:

a plurality of nozzles;

heaters arranged in correspondence with the plurality of nozzles;

a plurality of temperature sensors including a first sensor and a second sensor;

a first generating unit configured to select the first sensor from the plurality of temperature sensors, and in a first period and a second period that follows the first period, generate a first temperature signal;

a second generating unit configured to select the second sensor from the plurality of temperature sensors, and in the second period and a third period that follows the second period, generate a second temperature signal;

a processing unit configured to receive the first temperature signal and the second temperature signal, and based on values of the received signals, output a signal indicating a discharge state;

a determination unit configured to determine a discharge state based on the signal indicating the discharge state outputted from the processing unit and output a determination result signal(RSLT); and a switching unit configured to output to the processing unit the first temperature signal from the start of the second period until a predetermined timing of the second period, and at the predetermined timing, to switch a signal to be outputted to the processing unit from the first temperature signal to the second temperature signal; and the printing apparatus comprising:

a control unit configured to select a heater to be driven based on the determination result signal output from the determination unit.

12. The print element substrate according to claim 1, wherein the switching unit includes a comparator that compares a value of the first temperature signal to a value of the second temperature signal.

13. A print element substrate comprising:

a plurality of nozzles;

heaters arranged in correspondence with the plurality of nozzles;

a plurality of temperature sensors including at least a first temperature sensor and a second temperature sensor;

a selection unit configured to select the first temperature sensor and the second temperature sensor from the plurality of temperature sensors in order, by selecting the first temperature sensor before a difference between an output value from the first temperature sensor and an output value from the second temperature sensor becomes lower than a predetermined value, and by selecting the second temperature sensor after the difference became lower than the predetermined value; and a processing unit configured to output a signal indicating a discharge state based on an output value from a temperature sensor selected by the selection unit.

14. The print element substrate according to claim 13, wherein the print element substrate comprises at least a plurality of generation units that generate a first temperature signal about the first temperature sensor and a second temperature signal about the second temperature sensor, and wherein the plurality of generation units generate the first temperature signal and then generate the second temperature signal after a predetermined time has elapsed.

15. The print element substrate according to claim 13, wherein the selection unit comprises a comparator that compares a value of a first temperature signal to a value of a second temperature signal.

16. The print element substrate according to claim 13, wherein the selection unit comprises a plurality of diodes including at least a first diode that flows a first temperature signal and a second diode that flows a second temperature signal, and wherein the plurality of diodes are provided on a common signal line that connects the selection unit and the processing unit.

17. The print element substrate according to claim 13, wherein the processing unit includes a bandpass filter, and a determination unit configured to generate signal indicating a discharge state based on a value of output from the bandpass filter and a threshold value.

18. A printhead comprising:

a plurality of nozzles;

heaters arranged in correspondence with the plurality of nozzles;

a plurality of temperature sensors including at least a first temperature sensor and a second temperature sensor;

a selection unit configured to select the first temperature sensor and the second temperature from the plurality of temperature sensors in order, by selecting the first temperature sensor before a difference between an output value from the first temperature sensor and an output value from the second temperature sensor becomes lower than a predetermined value, and by selecting the second temperature sensor after the difference became lower than the predetermined value; and a processing unit configured to output a signal indicating a discharge state based on a value of the one temperature signal selected by the selection unit.

19. The printhead according to claim 18, wherein the printhead comprises at least a plurality of generation units that generate a first temperature signal about the first temperature sensor and a second temperature signal about the second temperature sensor, and wherein the plurality of generation units generate the first temperature signal and then generate the second temperature signal after a predetermined time has elapsed.

20. The printhead according to claim 18, wherein the selection unit comprises a comparator that compares a value of a first temperature signal to a value of a second temperature signal.

21. The print element substrate according to claim 13, wherein the selection unit selects the first temperature sensor before the output value from the second temperature sensor becomes equal to the output value from the first temperature sensor, and selects the second temperature sensor after the output value from the second temperature sensor became equal to the output value from the first temperature sensor.

22. The printhead according to claim 18, wherein the selection unit selects the first temperature sensor before the output value from the second temperature sensor becomes equal to the output value from the first temperature sensor, and selects the second temperature sensor after the output value from the second temperature sensor became equal to the output value from the first temperature sensor.

23. A printing apparatus that has a printhead, the printhead comprising:

a plurality of nozzles;

heaters arranged in correspondence with the plurality of nozzles;

a plurality of temperature sensors including at least a first temperature sensor and a second temperature sensor;

a selection unit configured to select the first temperature sensor and the second sensor from the plurality of temperature sensors in order, by selecting the first temperature sensor before a difference between an output value from the first temperature sensor and an output value from the second temperature sensor becomes lower than a predetermined value, and by selecting the second temperature sensor after the difference became lower than the predetermined value; and a processing unit configured to output a signal indicating a discharge state based on an output value from a temperature sensor selected by the selection unit, and the printing apparatus comprising:

a control unit configured to select a heater to be driven based on the signal indicating a discharge state output from the processing unit.

* * * * *